US008746543B2

(12) United States Patent
Jolley et al.

(10) Patent No.: US 8,746,543 B2
(45) Date of Patent: Jun. 10, 2014

(54) DISPLAY READY CONTAINER

(75) Inventors: Carl Jeffrey Jolley, Plymouth Meeting, PA (US); Andrew Sypawka, Doylestown, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 1001 days.

(21) Appl. No.: 11/421,642

(22) Filed: Jun. 1, 2006

(65) Prior Publication Data

US 2007/0278282 A1 Dec. 6, 2007

(51) Int. Cl.

| | |
|---|---|
| ***B65D 43/08*** | (2006.01) |
| ***B65D 3/22*** | (2006.01) |
| ***B65D 17/00*** | (2006.01) |
| ***B65D 5/46*** | (2006.01) |

(52) U.S. Cl.

USPC ..... 229/125.19; 229/122.32; 229/228; 229/244; 229/117.13; 206/736

(58) Field of Classification Search

USPC ..... 229/125.19, 120.11, 122.32, 122.33, 229/122.34, 228, 225, 243, 244, 224, 219, 229/118, 734, 226, 104; 206/736, 774

See application file for complete search history.

(56) References Cited

U.S. PATENT DOCUMENTS

| | | | | |
|---|---|---|---|---|
| 3,040,957 | A * | 6/1962 | Meyers | 229/228 |
| 3,423,005 | A * | 1/1969 | Leibson et al. | 229/228 |
| 5,065,937 | A * | 11/1991 | Ritter | 229/117.13 |
| 5,238,179 | A * | 8/1993 | Hart | 229/117.13 |
| 5,348,147 | A * | 9/1994 | Gottfreid | 206/215 |
| 5,417,342 | A * | 5/1995 | Hutchison | 229/122.32 |
| 5,505,368 | A | 4/1996 | Kanter et al. | |
| 5,507,430 | A * | 4/1996 | Imhoff | 229/125.19 |
| 5,524,815 | A * | 6/1996 | Sheffer | 229/120.18 |
| 6,189,777 | B1 * | 2/2001 | Hutchinson et al. | 229/120.37 |
| 7,080,736 | B2 * | 7/2006 | Jackson et al. | 206/738 |

OTHER PUBLICATIONS

U.S. Appl. No. 11/277,583, filed Mar. 27, 2006 with A. Sypawka as a named inventor.

* cited by examiner

*Primary Examiner* — Anthony Stashick
*Assistant Examiner* — Latrice Byrd
(74) *Attorney, Agent, or Firm* — Fox Rothschild LLP

(57) ABSTRACT

A container assembly having an inner container and an outer cover fixedly attached to one another. The inner container has multiple sidewalls for forming the inner container sidewalls and has a bottom forming flap attached thereto. The outer cover has multiple cover sidewalls that fit over the inner container sidewalls to enclose the inner container. At least one attachment member attached to and extending from the outer cover is attached to the bottom forming flap, thereby fixedly attaching the inner container to the outer container. The attachment member can be separated from the container outer cover to allow removal of the outer cover from the inner container without marring the finish of the outside face of the sidewalls of the inner container. A knockdown assembly that is erectable to form the container assembly is also provided.

17 Claims, 5 Drawing Sheets

FIG. 6
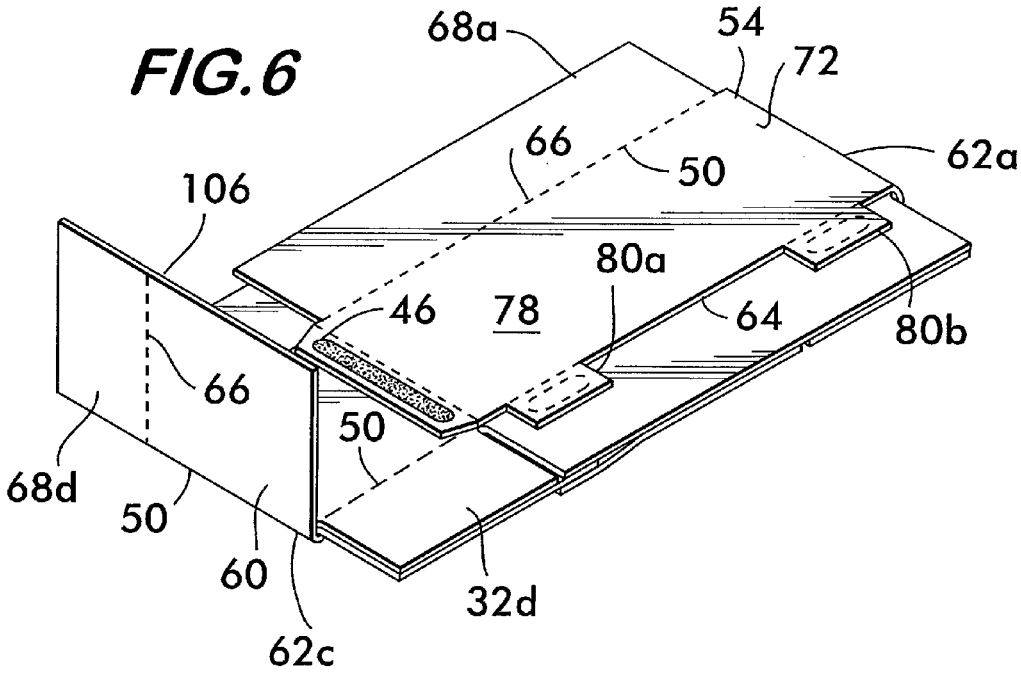
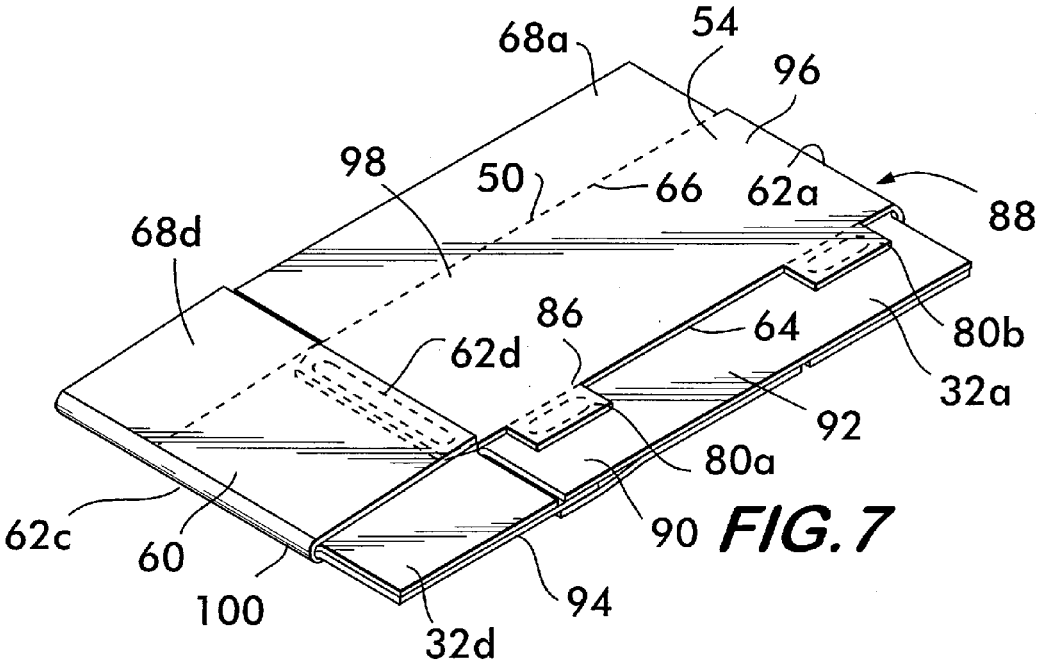
FIG. 7

DISPLAY READY CONTAINER

BACKGROUND OF THE INVENTION

1. Field of the Invention

The present invention pertains to containers used for packaging, shipping, and displaying goods. More particularly, the invention relates to containers having a bottom or inner container section for holding goods therein, and a removable upper or outer cover section for covering the bottom section.

2. Description of Related Art

Display ready containers have become very popular, particularly in retail stores where goods for sale are displayed in the container. A typical display ready container has separate top and bottom sections formed from separate corrugated blanks. The bottom section, also referred to as an inner container, has side walls and flaps for forming the container bottom. The upper section, also referred to as the outer cover section, has side walls and flaps for forming the container top. The upper section fits over the side walls of the bottom section to enclose the interior of the container and protect the goods inside. The upper and bottom sections can then be secured together for shipping. Once the container is at the retailer, the upper section can be removed to display the goods within the container.

Display ready containers are particularly useful as shipping-display containers. Used to package and ship goods for retail, the outside face of the bottom section can be printed and/or designed with promotional information suitable for display on the retail floor. The retailer removes the upper section of the container and places the bottom container section containing the goods on the retail floor.

A previous disadvantage of such two piece containers is the number of steps necessary to assemble the container. This disadvantage was overcome with the development of display ready containers that allow for the automation of the set up, packaging and sealing of such containers. One such display ready container is disclosed in U.S. Pat. No. 5,505,368 which is hereby incorporated herein by reference. This patent provides a container assembly having an unopened outer sleeve (that forms the outer cover section when erected), and an unopened inner sleeve (that forms the inner container section when erected) positioned inside the outer sleeve. The inner and outer sleeves, in a flat unopened form also known as a knockdown, are adhered together relative to one another in the positional relationship of the final erected container assembly which allows the top forming flaps of the container assembly to be closed. This allows the container to be erected and filled with goods with the outer cover section (upper section) already secured to the bottom container section. Once the container is filled with the goods, the top forming flaps attached to the outer cover section are folded over and sealed shut to enclose the container for shipment, thereby eliminating the step of placing the outer cover section over the bottom section, and thereby improving the automation of the packaging process. For display, the retailer then separates the two container sections by breaking the adhesive joints between the two container sections, discarding the upper cover section, and using the bottom container section to hold and display goods on the retail floor.

One problem with such improved display ready containers is that when breaking the adhesive joints between the two container sections, the outer surface of the inner container can tear, marring the printed image visible to the customer. Accordingly, one object of the present invention is to provide an improved display ready container that avoids this problem. Other advantages will be obvious or may be learned by practice of the invention.

SUMMARY OF THE INVENTION

In one form the present invention provides a container knockdown assembly capable of being erected into a container assembly. The knockdown has an inner container for holding goods and an outer cover for enclosing the inner container. The knockdown assembly further includes an inner sleeve capable of forming the inner container when the knockdown assembly is erected. The inner sleeve has first and second inner sleeve walls which include inner container sidewalls, a top edge, and a bottom forming flap opposite the top edge. The knockdown assembly also includes an outer sleeve capable of forming the outer cover when the knockdown assembly is erected. The outer sleeve has first and second outer sleeve walls which form outer cover sidewalls when the knockdown is erected, a bottom edge, and a top forming flap opposite the bottom edge. At least one attachment member is attached to and extends from the outer sleeve and is attached to the bottom forming flap of the inner sleeve so as attach the inner sleeve to the outer sleeve, the inner sleeve being fixedly positioned within the outer sleeve in an aligned relationship so as to be in a same relative position of the inner container to the outer cover of the erected container assembly.

The present invention also provides a container assembly. The container assembly includes an inner container having multiple sidewalls for forming outer walls of the inner container and which are capable of holding goods therein. The multiple side walls have a top edge and a bottom flap opposite the top edge which extends from a lower end of the multiple side walls to form the container bottom. The container assembly further includes an outer cover having multiple cover sidewalls and which are configured to fit over the inner container, which outer cover sidewalls have a bottom edge and a top forming flap opposite the bottom edge to form the cover top for enclosing the inner container. The inner container is positioned within the outer cover, and the outer cover includes at least one attachment member attached to and extending from the outer cover and is attached to the bottom forming flap of the inner container thereby fixedly attaching the inner container to the outer container in a position so that the top flap of the outer cover is foldable to enclose the container assembly.

BRIEF DESCRIPTION OF THE DRAWINGS

The foregoing summary, as well as the following detailed description, will be better understood when read in conjunction with the accompanying drawings. For the purpose of illustrating the invention, there are shown in the drawings a preferred embodiment. It is understood, however, that this invention is not limited to this embodiment and is to be limited only by the appended claims.

FIG. 6 is a perspective view showing a step of making the knockdown of FIG. 7 that comes after the step shown in FIG. 5;

FIG. 7 is a perspective view of a container knockdown assembly that can be erected to form the container assembly shown in FIG. 1;

DETAILED DESCRIPTION

The invention disclosed herein provides a novel container assembly and a container knockdown assembly. Described below is a preferred embodiment of the invention suited for containers used for shipping and displaying goods for retail. It is understood, however, that the present invention is not so limited and can be adapted to other types of containers.

Figure 1:
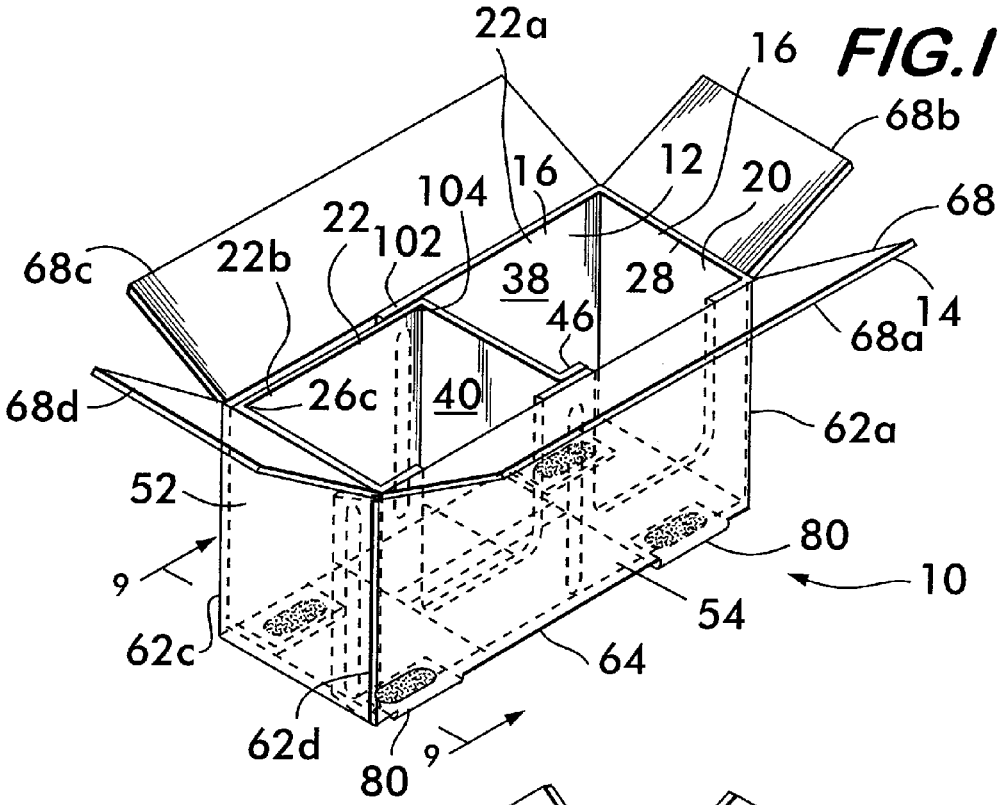
FIG. 1 is a perspective view of an erected container assembly made in accordance with the present invention showing the inner container within the outer cover, the top flaps folded outwardly, and the bottom flaps folded to form the container bottom.

Reference now will be made in detail to the FIGS. 1 through 9, with initial reference to FIGS. 1 through 9, and also to FIG. 8 which shows the container assembly sections separated from one another. Display ready container assembly 10 has an inner container 12, shown partially in dotted line where hidden in FIG. 1, which is secured to and positioned within an outer container cover 14. These two container sections 12 and 14, with the inner container 12 fixedly secured within the outer cover 1, form the display ready container assembly 10. The inner container 12 holds the goods to be contained within, and the outer cover 14 will ultimately enclose the inner container 12. This is a display ready container in that the container assembly 10 as shown in FIG. 1 has the inner container 12 and the outer cover 14 fixedly attached to one another in the same relative position to one another of the final closed container as further described below, and similar in this regard to the container shown in U.S. Pat. No. 5,505,368 which is hereby incorporated by reference herein. The individual display ready container sections 12 and 14 are now described separately in more detail.

The inner container 12 includes multiple inner container sidewalls 16 which form four container side walls, i.e. a front wall 18 (see FIG. 8), side wall 20, rear wall 22 and second side wall 24, and which are attached to one another at corners 26*a*, 26*b*, 26*c*, and 26*d*. The container sidewalls 16 have a top edge 28 and a lower end 30 opposite the top edge 28. A bottom forming flap 32 is attached to and extends from the lower end 30 of the multiple sidewalls 16, which flap 32 includes individual flaps 32*a*, 32*b*, 32*c*, and 32*d*, attached to and extending from the lower end 30 of the side walls 18, 20, 22, and 24 and which are foldable to form the bottom 34 of the inner container 12. The sidewalls 16 have an outer face 36 and an inner face 38. Dividing the container 12 into two sections is a divider wall 40. Two display openings 42 are formed in the front wall 18 as shown to provide visual and user access to the two container internal sections formed by the divider wall 40. In the illustrated embodiment, the rear wall 22 is formed from two wall sections 22*a* and 22*b* adhesively attached to one another as known in the art. Similarly, the bottom flap 32*c* is formed from two flap sections 32*c*1 and 32*c*2 adhesively attached to one another.

Figure 3:
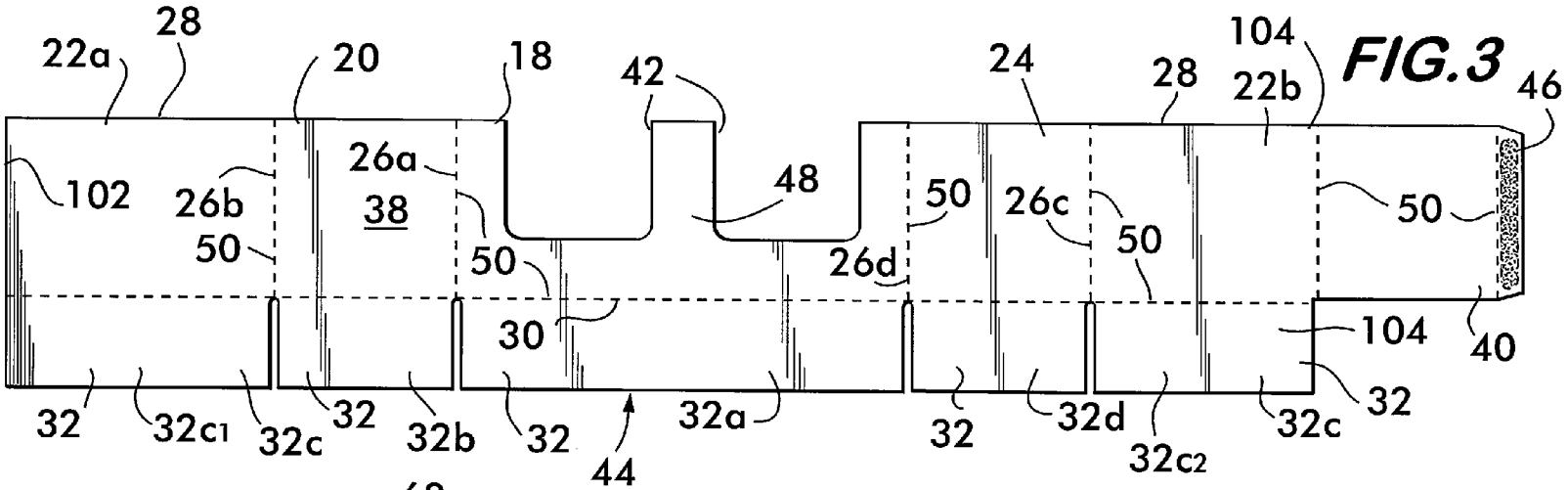
FIG. 3 is a plan view of a blank section for forming the inner sleeve of the knockdown shown in FIG. 7 and which can be erected to form the inner container of the container assembly in FIG. 1.

The inner container 12 is preferably formed or cut from a unitary blank 44, preferably of corrugated paper board as shown in FIG. 3, which shows the inner face 38 of the blank 44. A glue tab 46 attached to the end of the divider wall 40 is provided to attach the divider wall 40 to the inside face 38 of the front wall 18 in the area 48 between the two display openings 42. Fold lines 50, such as scores or creases formed in corrugated paperboard, define the various sidewalls 16 and bottom forming flaps 32, and predispose the various sidewalls and flaps of the inner container 12 to fold easily along such lines. The fold lines 50 can be formed in any known manner.

The outer cover 14 is now described with reference to FIGS. 1, 2, 8, and 9. The outer cover 14 includes multiple outer cover sidewalls 52 which form the cover front wall 54, side wall 56, rear wall 58 and second side wall 60, and which are attached to one another at corners 62*s*, 62*b*, 62*c*, and 62*d*. The sidewalls 52 have a bottom edge 64 and an upper end 66. Top forming flaps 68, which include flaps 62*a*, 68*b*, 68*c*, and 68*d* attached to and extending from the upper end 66, can be folded to form the top 70 of the outer cover 14. The sidewalls 52 have an outer face 72 and an inner face 74.

Figure 4:
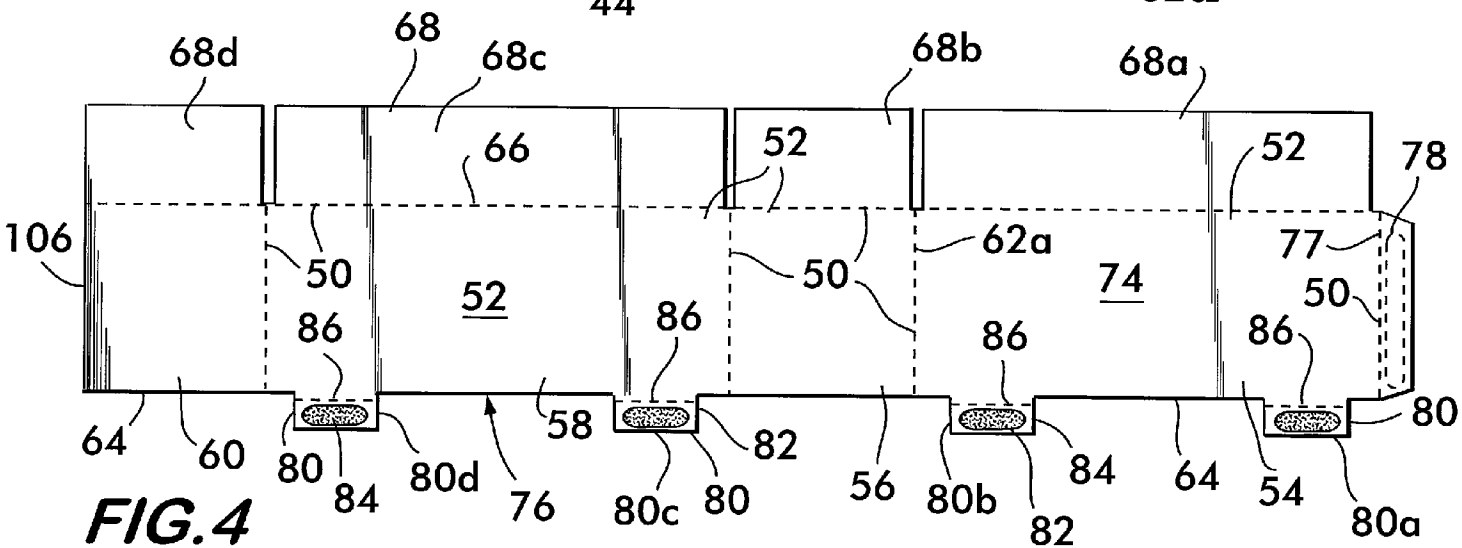
FIG. 4 is a plan view of a blank section for forming the outer sleeve of a knockdown shown in FIG. 7 and which can be erected to form the outer cover of the container assembly in FIG. 1.

The outer cover 14 is preferably formed or cut from a unitary blank 76 preferably of corrugated paper board as shown in FIG. 4, which shows the blank inner face 74. A glue tab 78 attached to the end 77 of the side wall 54 connects the cover side wall 54 to the cover side wall 60 at the corner 62*d* to form the outer cover 14. Fold lines 50, such as scores or creases formed in corrugated paperboard, define the various sidewalls 52 and top forming flaps 68, and predispose the various sidewalls and flaps of the outer cover 14 to fold easily along such lines.

Figure 2:
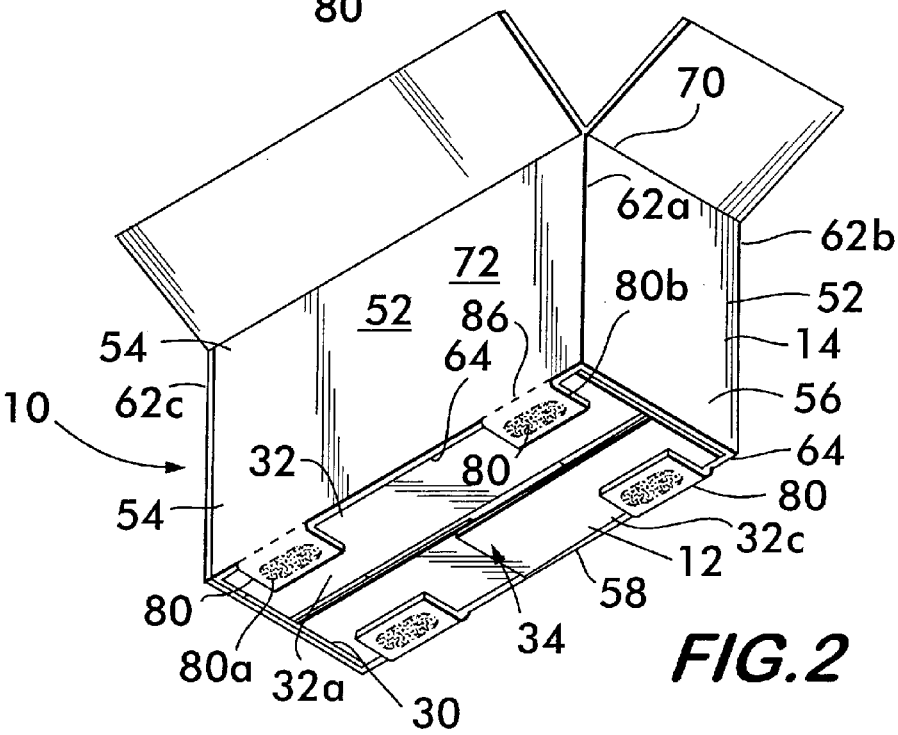
FIG. 2 is a bottom perspective view of the container shown in FIG. 1.

At least one attachment member 80 attaches the outer cover 14 and the inner container 12 together. The attachment member is preferably a flap integrally formed as part of the outer cover 14 as shown in FIG. 4 and which extends from the bottom edge 64. The attachment member 80 has an adhesive section 82 that is attached to one of the bottom forming flaps 32 with an adhesive 84. Other suitable attachment means may be used. As best seen in FIG. 2, the attachment member 80 of the illustrated embodiment includes multiple flaps 80*a*, 80*b*, 80*c*, and 80*d*, two of the flaps extending from the outer cover side wall 54 and which are adhesively attached to the bottom flap 23*a*, and the other two flaps 80*c*, 80*d* extending from the outer cover side wall 58 which are adhesively attached to bottom flap 32*c*.

Figure 8:
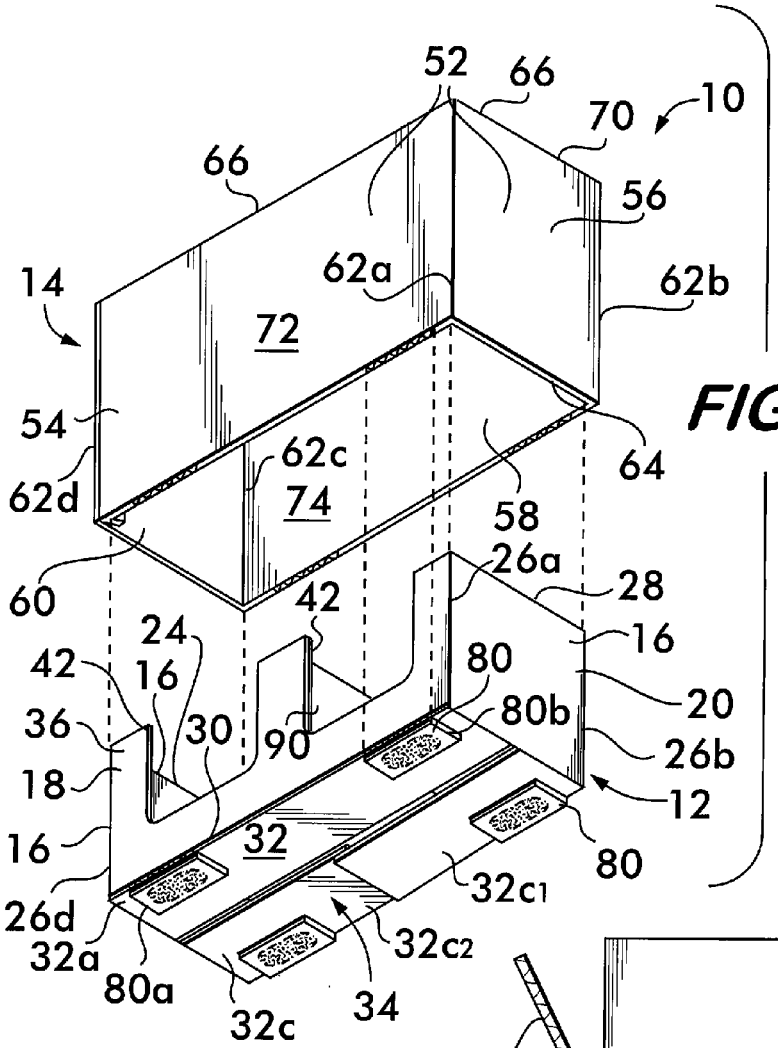
FIG. 8 is a view of the outer cover shown removed from the inner container after the outer cover has been detached from the inner container.
Figure 9:
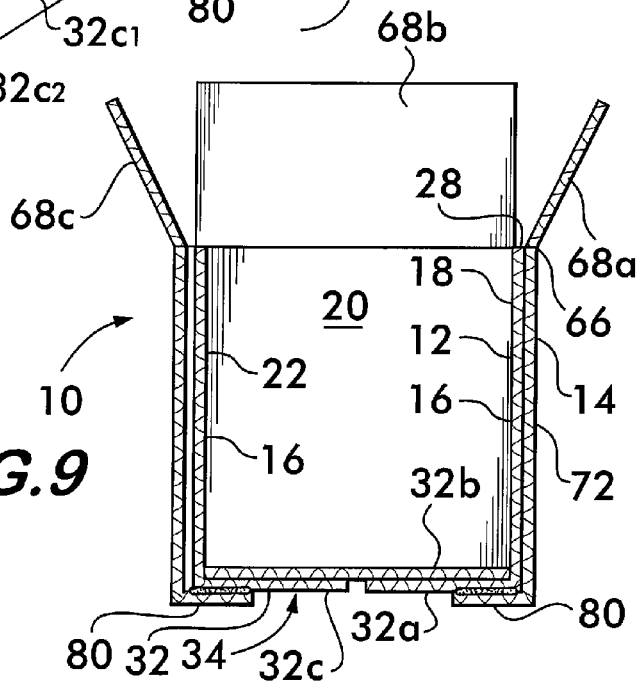
FIG. 9 is a cross-sectional view taken along line 9-9 of FIG. 1.

The attachment member 80, or at least a portion of it, is detachable from the outer cover 14 to allow the outer cover 14 to be separated and removed from the inner container 12 of the erected container assembly 10 as shown in FIG. 8. In the preferred embodiment, a line of weakness 86 is provided along which the outer cover 14 can be separated from the inner container 12. With reference to FIGS. 2 and 8, the line of weakness 86 is formed as a line of perforations adjacent to the bottom edge 64 of the outer cover 14 from where the attachment members extend. This line of weakness is tearable by a person using his or her fingers to detach the outer cover 14 from the inner container 12 so that the outer cover 14 can be removed, leaving the inner container 12 with the goods within. As seen in FIG. 8, the attachment flaps 80*a*, 80*b*, 80*c*, and 80*d*, or at least that portion of them that are separated from the remainder of the outer cover 14 via the line of weakness 86, remains attached to the inner container 12. It is preferable to provide the line of weakness 86 on the attachment member 80 at or below the edge 64 (see FIG. 4) to minimize the torn material visible on the side of the inner container 12.

It is seen that by attaching the inner container 12 and outer cover 14 together with an attachment member 80 that is located on the bottom of the container assembly 10, tearing, separating, or even breaking of the adhesive between the attachment member 80 and bottom flaps 32 is done with a section of the container assembly 10 on the bottom of the inner container 12, and thus will not tear or mar the sidewalls 16 of the inner container 12.

Figure 5:
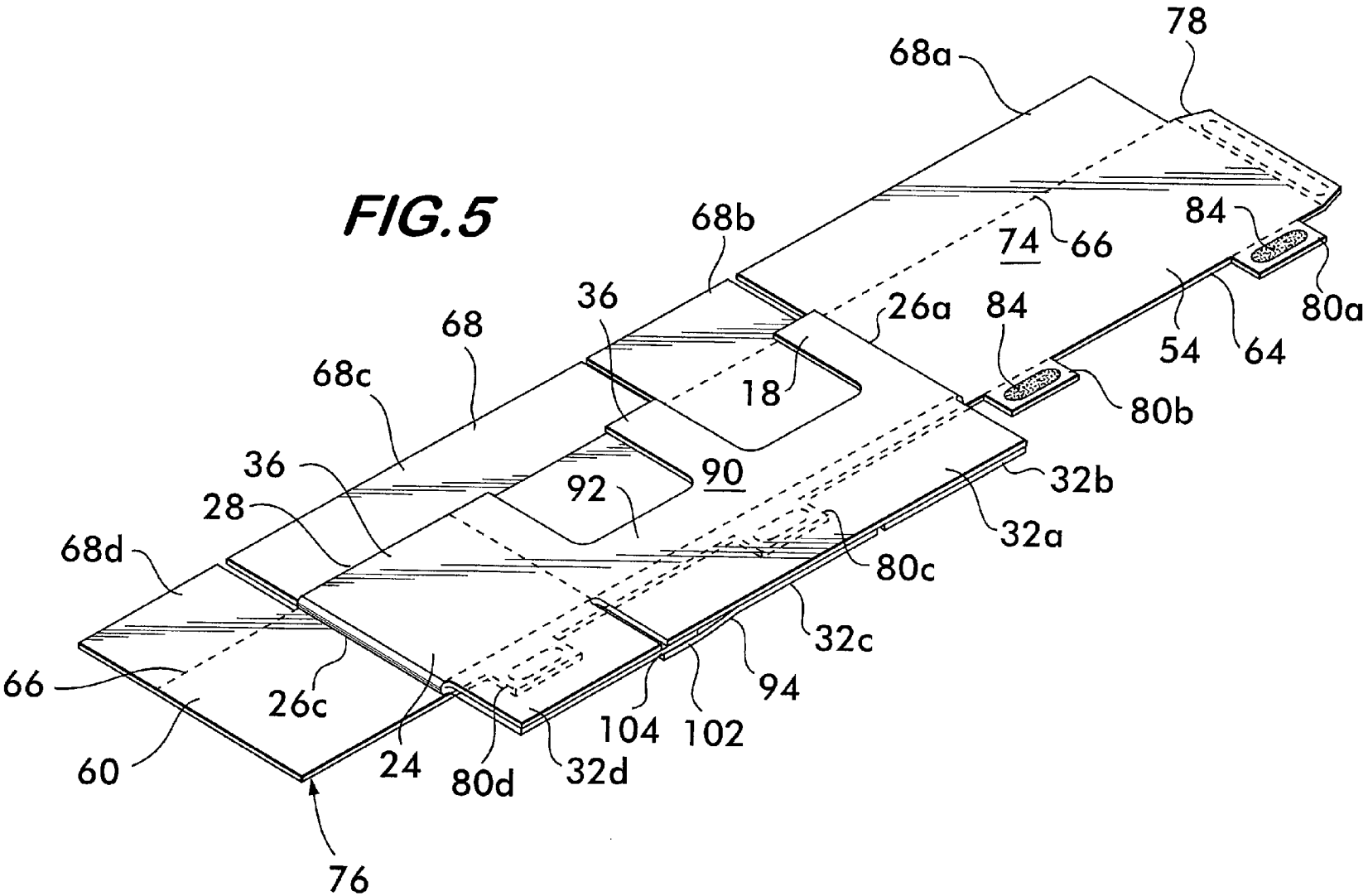
FIG. 5 is a perspective view showing a step of making the container knockdown assembly shown in FIG. 7, where the inner sleeve is positioned on the inner face of the blank that will form the outer sleeve.

The container assembly 10 as shown in FIG. 1 can be erected from a container knockdown assembly 88 which is now described with reference to FIGS. 5 and 7. FIG. 7 shows the container knockdown assembly 88, and FIG. 5 shows a step in the process of making the container knockdown assembly 88 which shows a section of the outer container 14 removed to make visible the inner container 12 in its knockdown form. The container knockdown assembly 88 has an inner sleeve 90 which can be erected to form the inner container 12. It has a first inner sleeve wall 92 that includes the inner container sidewalls 18 and 24, and the attached bottom forming flaps 32*a* and 32*d*, all in a substantially flat same plane. The inner sleeve 90 further has a second inner sleeve wall 94 that includes the inner container sidewalls 20 and 22, and the attached bottom forming flaps 32*b* and 32*c*, all in a substantially flat same plane which is parallel to the first inner sleeve wall 92. The first and second inner sleeve walls 92 and 94 are attached to one another at the inner container corners 26*a* and 26*c*, the corners 26*b* and 26*d* not being formed until the container assembly 10 is erected.

The container knockdown assembly 88 also has an outer sleeve 96 which can be erected to form the outer cover 14. It has a first outer sleeve wall 98 that includes the outer cover sidewalls 54 and 60, and the attached top forming flaps 68*a* and 68*d*, all in a substantially flat same plane. The outer sleeve 96 further has a second outer sleeve wall 100 that includes the outer container sidewalls 56 and 58, and the attached bottom forming flaps 68*b* and 68*c*, all in a substantially flat same plane which is parallel to the first outer sleeve wall 98 (which are underneath the inner sleeve 90 in FIG. 7). The first and second outer sleeve walls 98 and 100 are attached to one another at the outer cover corners 62*a* and 62*c*, the corners 62*b* and 62*d* not being formed until the container assembly 10 is erected. The container knockdown assembly 88 can be stacked with other such knockdowns for efficient shipment to the packager where they are readily erected by automated packaging machinery.

With reference to FIGS. 3, 4, 5, 6, and 7, one preferred method for manufacturing the container knockdown assembly 88 is now described. With initial reference to FIGS. 3 and 5, first the inner sleeve 90 as shown in FIG. 5 is formed from the blank 44 shown in FIG. 3 (which shows the inside face 38 of the blank). The side wall section 22*b*, divider wall 40, and bottom flap section 32*c*2 are folded together as a unit about the fold line 50 that will form the container corner 26*c* onto the inner face 38 of adjacent side walls 24 and 18. Adhesive, such as hot melt glue, is applied to attach the glue tab 46 to the attachment area 48 between the two display openings 42. Next, the side wall panel section 22*a* with the bottom flap section 32*c*1 and the side wall panel 20 with bottom flap 32*b*, are folded together as a unit about the fold line 50 that will form the container corner 26*a* so that the inside face 38 of the edge area 102 of the side wall panel section 22*a* and the bottom flap section 32*c*1 contact the attachment area 104 on the outer face 36 of the side wall section 22*b* and bottom flap section 32*c*2, which are attached to one another with an adhesive to form the complete side wall 22 and bottom flap 32*c*. A sufficient overlap of the side wall 22 and the bottom flap 32*c*1 onto the wall panel 22*b* and bottom flap 32*c*2 is provided for a sufficiently strong joint. The divider panel 40 is sandwiched between the two inner sleeve walls 92 and 94. This forms the inner sleeve 90 as shown in FIG. 5 (after the sleeve 90 is turned upside down after the manufacturing steps described above) having the two inner sleeve walls 92 and 94 as described previously.

Next, the outer sleeve 96 is formed from the blank 76 around the inner sleeve 90 to form the container knockdown assembly 88 as illustrated in FIGS. 4, 5, 6, and 7. With initial reference to FIG. 4, an adhesive 84 is applied to the inner face 74 of the adhesive members 80. Any suitable adhesive of sufficient strength and amount can be used, such as hot melt glue. The adhesive 84 preferably should be sufficiently strong to hold the attachment members 80 in place and allow separation of the inner and outer sections 12 and 14 from one another as describe below. Next, as illustrated in FIG. 5, the inner sleeve 90 is laid onto the inner face 74 of the blank 76 in an aligned relationship of the erected container assembly 10. That is, the inner sleeve 90 is positioned onto and relative to the blank 76 (outer sleeve 96) so as to be in the same position relative to the outer sleeve 96 as that of the erected container assembly 10 shown in FIG. 1. Accordingly, in the illustrated embodiment shown in FIG. 5, the corresponding side walls 18-24 and corners 26*a*-26*d* of the inner container 12 align with respective outer cover sidewalls 54-60 and corners 62*a*-62*d*, e.g., the inner container walls 20 and 22 of the inner sleeve 90 (inner container 12) are positioned on and aligned with the outer cover side walls 56 and 58 respectively of the blank 76 (of outer cover 14 and outer sleeve 96); the fold line 50 of the inner sleeve 90 that will form the inner container corner 26*b* is aligned with the fold line 50 of the outer sleeve 96 that will form the outer cover corner 62*b*; the top edge 28 of the walls 18-24 of the inner container sleeve 90 is aligned with or below the top end 66 of the outer cover sleeve 96 so as not to prevent the top forming flaps 68*a*, 68*b*, 68*c*, and 68*d* from being capable of folding to form the top 70 when enclosing the erected container 10. Preferably, as illustrated, the top edge 28 of the inner container sleeve 90 aligns substantially with the top end 66 of the outer cover sleeve 96 and the bottom edge 64 of the outer sleeve 96 aligns substantially with the bottom end 30 of the inner sleeve 90 to fully support the sidewalls of the inner container 12. Moreover, it is seen that the attachment members 80*c*, 80*d* with adhesive 84 applied to their inside face, are adhered at this time to the outer face of the bottom forming flaps 32*c* and 32*d* of the inner container sleeve 90.

Next, with further reference to FIGS. 5 and 6, the side wall 54 and top flap 68*a* are folded as a unit along the fold line 50 that will form the outer cover corner 62*a* (aligned with corner 26*a* of the inner sleeve 90) onto the outside face 36 of side wall 18 of the inner container sleeve 90. The attachment members 80*a* and 80*b*, with adhesive 84, contact and adhere to the outer face 36 of the bottom flap 32*a* (see FIG. 6).

With reference to FIGS. 6 and 7, adhesive, such as a hot melt glue, is then applied to the outside face 78 of the glue tab 46, and then the side wall 60 and top flap 68*d* are folded together as unit along the fold line 50 that will form the container corner 62*c*, onto the outer face 36 of the side wall 24 of the inner container sleeve 90 such that the area 106 adjacent the end of the outer cover wall 60 contacts the adhesive of the glue tab 46, thereby forming the two sided outer sleeve 96 (outer cover 14). Once the outer sleeve 96 is formed with the inner sleeve 90 fixedly secured within it, it is seen that a flat container knockdown assembly 88 is formed. Such flat assemblies are efficiently stacked for storage and shipment.

Referring to FIGS. 1 and 7, the container knockdown assembly 88 is erected into the container assembly 10 by pushing the corners 62*a* and 62*c* toward each other, folding and forming the corners 62*b* and 62*d* of the outer cover 14 and corners 26*a* and 26*c* of the inner container 12 until an erected container assembly 10 is formed as shown in FIG. 1. It is seen that this opens both of the inner and outer sleeves 90, 96 as a single unit. The bottom forming flaps 32 of the inner container 12 are then folded and secured to form the container bottom 34, allowing the container assembly 10 to be loaded with goods. It is seen that the attachment flaps 80 move with the bottom forming flaps 32 and thus fold relative to the side walls 52 of the outer cover 14. Thus the line of weakness 86, if positioned at the same position that the attachment members fold, will act as a fold line in addition to a separation line. Once the goods are loaded, the top forming flaps 68 of the outer cover 14 are folded and secured to form the top 70 to enclose the goods within the container 10 for shipment. It is seen that in this preferred embodiment, the height of the sidewalls 16 and 52 of respective inner container 12 and outer cover 14 are substantially the same so that the outer cover 14 fully covers the inner container 12. Additionally, this configuration provides two layers of support on each side of the container assembly 10 for increased stacking strength. Moreover, this configuration provides attachment members 80 of the shortest length, it being appreciated that if the bottom edge 64 of the outer sleeve 96 were not far enough down to align with the lower end 30 of the inner sleeve 90, the attachment members would have to be longer in length to reach the bottom flaps 32, with the line of weakness 86 positioned in the portion of the attachment member on the bottom flaps 32.

The "aligned relationship" of the inner container 12 and outer cover 14 of the erected container assembly 10 as discussed above is the position of the inner container 12 and outer cover 14 relative to one another in the erected container assembly 10 as seen in FIG. 1. By securing the container and cover sections 12 and 14 in this aligned relationship to one another during the manufacture of the knockdown assembly 88, it is appreciated that no further handling of the cover 14 relative to the inner container is to be made. Once loaded, the container assembly 10 is closed simply by folding the top flaps 68*a*, 68*b*, 68*c*, and 68*d*. Since the outer cover 14 was previously attached to the inner container 12 at the aligned relationship of the erected container assembly 10, the enclosure process is complete and the container 10 is ready for stacking with other containers and shipping. This eliminates the step of placing or maneuvering the outer cover section 14 into the proper position over an inner container after the loading of the goods.

As illustrated in FIG. 8, the outer cover 14 is removed from the inner container 12 to display the goods held within the inner container 12. This is accomplished by detaching the outer cover 14 from at least a portion of the attachment member 80 and lifting the outer cover 14 from the inner container 12 as shown. In one preferred embodiment, with a sufficiently strong adhesive 84, a person can tear the attachment members 80 along the line of weakness 86 with their fingers. The attachment members 80, through which the inner container 12 is adhesively fixed to the outer cover 14, remains with and adhered to the bottom of the inner container 12 when the outer cover 14 is removed.

Since the inner container 12 may be used to display the goods on the retail floor, the outer face 36 of the side walls 16 may be printed with an esthetic design or some suitable promotional information. Since there is no breaking of a glue joint on the outside face 36 of the inner container 12, the outer face 36 is not marred by the separation of the outer cover 14 from the inner container 12.

The present invention thereby provides a container knockdown assembly 88, which is simple and efficient to make, and a container assembly 10, which in a preferred form, is easily erected from a knockdown assembly 88, both of which are improved over previously known display ready containers.

While particular embodiments of the invention are described herein, it is not intended to limit the invention to such disclosure. Changes and modifications may be incorporated and embodied within the scope of the appended claims.

What is claimed is:

1. A container knockdown assembly capable of being erected into a container assembly having an inner container for holding goods and an outer cover for enclosing said inner container, said knockdown assembly comprising:

an inner sleeve capable of forming said inner container when said knockdown assembly is erected, said inner sleeve having first and second inner sleeve walls which define inner container sidewalls having a top edge and bottom edge, and at least one bottom forming flap extending from a respective sidewall bottom edge at a bottom edge fold line, said first and second inner sleeve walls having inner and outer faces, with said inner faces adjacent one another;

an outer sleeve capable of forming said outer cover when said knockdown assembly is erected, said outer sleeve having first and second outer sleeve walls which define outer cover sidewalls having a top edge and a bottom edge, and at least one top forming flap extending from a respective sidewall top edge at a top edge fold line, said first and second outer sleeve walls having inner and outer faces, with said inner faces adjacent respective ones of the inner sleeve wall outer faces;

at least one attachment member attached to and extending from a bottom edge of said outer sleeve and attached to said bottom forming flap of said inner sleeve so as to attach said inner sleeve to said outer sleeve, said inner sleeve being fixedly positioned within said outer sleeve in an aligned relationship so as to be in a same relative position of said inner container to said outer cover of the erected container assembly; and a line of weakness formed in said attachment member along which said outer sleeve is separable from said inner sleeve, such that said line of weakness is aligned with a respective bottom edge fold line or is spaced from the bottom edge fold line in a direction toward the bottom forming flap of said inner container.

2. A container knockdown assembly in accordance with claim 1 wherein said attachment member comprises a flap extending from and formed integrally with said outer sleeve.

3. A container knockdown assembly in accordance with claim 2 wherein said attachment member is attached to said bottom forming flap with an adhesive.

4. A container knockdown assembly in accordance with claim 3 wherein said inner and outer sleeves are adapted to be erected into a rectangular shaped container assembly, said attachment member comprises multiple flaps, said bottom forming flap comprises multiple flaps, said tear line comprises perforations, and wherein said adhesive comprises a hot melt glue.

5. A container knockdown assembly in accordance with claim 2 wherein said attachment member has an adhesive section that is attached to said bottom forming flap with an adhesive.

6. A container knockdown assembly in accordance with claim 5 wherein the line of weakness is tearable to allow said outer sleeve to be separated from said adhesive section and thereby removable from said inner sleeve.

7. A container knockdown assembly in accordance with claim 6 wherein said attachment member comprises multiple flaps integrally formed with and extending from said lower edge of said outer sleeve.

8. A container knockdown assembly in accordance with claim 2 wherein said line of weakness is formed between said bottom edge of said outer sleeve and said adhesive section of said attachment member.

9. A container knockdown assembly in accordance with claim 1 wherein said inner and outer sleeves form a substantially flat configuration.

10. A container knockdown assembly wherein said inner sleeve is fixedly positioned within and relative to said outer sleeve as claimed in claim 1 such that said top edge of said inner sleeve aligns substantially with said top edge fold line and said bottom edge of said outer sleeve aligns substantially with said bottom edge fold line.

11. A container knockdown assembly capable of being erected into a container assembly having an inner container for holding goods and an outer cover for enclosing said inner container, said knockdown assembly comprising:

an inner sleeve capable of forming said inner container when said knockdown assembly is erected, said inner sleeve having first and second inner sleeve walls which are foldable to form first, second, third and fourth inner container side walls when said knockdown assembly is erected, said first and second inner sleeve walls defining a top edge and a bottom edge along the container side walls, and at least one bottom forming flap extending from a respective one of the container side walls at a bottom edge fold line, said at least one bottom forming flap foldable to form an erected container bottom, said first and second inner sleeve walls having inner and outer faces, with said inner faces adjacent one another;

an outer sleeve capable of forming said outer cover when said knockdown assembly is erected, said outer sleeve having first and second outer sleeve walls which are foldable to form first, second, third and fourth cover sidewalls when said knockdown assembly is erected, said outer sleeve walls defining a bottom edge and a top edge, and at least one top forming flap extending from a respective one of the cover side walls at a top edge fold line, said at least one top forming flap foldable to form an erected container top, said inner sleeve being positioned within said outer sleeve in an aligned relationship so as to be in the same relative position of said inner sleeve to said outer sleeve of the erected container assembly, said first and second outer sleeve walls having inner and outer faces, with said inner faces adjacent respective ones of the inner sleeve wall outer faces;

said outer sleeve further comprising at least one attachment flap extending from said bottom edge of said outer sleeve, said attachment flap being adhesively attached to said bottom forming flap of said inner sleeve so as to fix said inner sleeve to said outer sleeve in said aligned relationship, said attachment flap being foldable with said bottom forming flap when said knockdown assembly is erected into the container assembly; and a line of weakness formed in said attachment flap, said line of weakness is aligned with a respective bottom edge fold line or is spaced from the bottom edge fold line in a direction toward the bottom forming flap of said inner container, and said outer sleeve being separable from said inner sleeve along said line of weakness.

12. A container knockdown assembly in accordance with claim 11 wherein said attachment flap is attached to said bottom forming flap with a hot melt adhesive.

13. A container knockdown assembly in accordance with claim 11 wherein said attachment flap has an adhesive section which is adhesively attached to said bottom forming flap.

14. A container knockdown assembly in accordance with claim 13 wherein the line of weakness is formed adjacent to said bottom edge of said outer sleeve which is tearable to allow said outer sleeve to be removable from said inner sleeve.

15. A container knockdown assembly in accordance with claim 11 wherein said bottom forming flap comprises multiple said bottom forming flaps, and wherein one of said attachment flaps is attached to one of said first, second, third and fourth outer cover sidewalls and one of said multiple bottom forming flaps, and a second of said attachment flaps is attached to another of said first, second, third and fourth cover sidewalls and another of said multiple bottom forming flaps.

16. A container knockdown assembly capable of being erected into a container assembly having an inner container for holding goods and an outer cover for enclosing said inner container, said knockdown assembly comprising:

an inner sleeve capable of forming said inner container when said knockdown assembly is erected, said inner sleeve having first and second inner sleeve walls which define inner container sidewalls having a top edge and bottom edge, and at least one bottom forming flap extending from a respective sidewall bottom edge at a bottom edge fold line, said first and second inner sleeve walls having inner and outer faces, with said inner faces adjacent one another;

an outer sleeve capable of forming said outer cover when said knockdown assembly is erected, said outer sleeve having first and second outer sleeve walls which define outer cover sidewalls having a top edge and a bottom edge, and at least one top forming flap extending from a respective sidewall top edge at a top edge fold line, said first and second outer sleeve walls having inner and outer faces, with said inner faces adjacent respective ones of the inner sleeve wall outer faces; and at least one attachment member extending from said bottom edge of a respective outer cover sidewall and attached to said bottom forming flap of said inner sleeve so as to attach said inner sleeve to said outer sleeve in a generally fixedly positioned, wherein a line of weakness is defined in said attachment member aligned with a respective bottom edge fold line or spaced from the bottom edge fold line in a direction toward the bottom forming flap of said inner container.

17. A container knockdown assembly in accordance with claim 16 wherein the inner sleeve wall outer faces and the outer sleeve wall inner faces are unattached to one another.

* * * * *